US006336309B1

(12) United States Patent
Groppi

(10) Patent No.: US 6,336,309 B1
(45) Date of Patent: Jan. 8, 2002

(54) METHOD AND APPARATUS FOR PROVIDING HYGENIC PROTECTION ON CANS OR GROUPS OF CANS

(75) Inventor: Silvano Groppi, Parma (IT)

(73) Assignee: Bantam Engineers Limited

( * ) Notice: Subject to any disclaimer, the term of this patent is extended or adjusted under 35 U.S.C. 154(b) by 0 days.

(21) Appl. No.: 09/214,152

(22) PCT Filed: Jul. 9, 1997

(86) PCT No.: PCT/EP97/03716

§ 371 Date: Mar. 1, 1999

§ 102(e) Date: Mar. 1, 1999

(87) PCT Pub. No.: WO98/04459

PCT Pub. Date: Feb. 5, 1998

(30) Foreign Application Priority Data

Jul. 26, 1996 (IT) ..... RE96A0058
Feb. 25, 1997 (IT) ..... RE97A0010

(51) Int. Cl.[7] ..... B21D 5/26; B65B 7/16

(52) U.S. Cl. ..... 53/484; 53/290; 53/453; 53/488; 53/556

(58) Field of Search ..... 53/290, 296, 297, 53/329.3, 329.5, 453, 487, 488, 559, 556

(56) References Cited

U.S. PATENT DOCUMENTS 3,046,711 A 7/1962 Harrison ..... 53/398
3,200,944 A * 8/1965 Rapata ..... 206/65
3,488,911 A * 1/1970 Poupitch ..... 53/27
3,716,963 A * 2/1973 Amberg ..... 53/296
4,018,027 A * 4/1977 Curry et al. ..... 53/48
4,281,502 A * 8/1981 Bonkowski ..... 53/398
4,724,655 A * 2/1988 Lew ..... 53/398
5,088,269 A * 2/1992 Thelen ..... 53/398
5,346,088 A * 9/1994 Brimo, II ..... 220/357

FOREIGN PATENT DOCUMENTS

| | | |
|---|---|---|
| EP | 0559293 | 9/1993 |
| FR | 2320241 | 3/1977 |
| FR | 2606364 | 5/1988 |
| GB | 2225566 | 6/1990 |
| WO | 9528328 | 10/1995 |
| WO | 9624539 | 8/1996 |

* cited by examiner

*Primary Examiner*—Scott A. Smith
*Assistant Examiner*—Hemant M Desai
(74) *Attorney, Agent, or Firm*—Birch, Stewart, Kolasch & Birch, LLP

(57) ABSTRACT

A method and apparatus for covering the top of a container with a cap made of a plastic material, wherein the container is hermetically sealed by said cap thereby protecting the top portion of the container and the contents of the container from contamination.

14 Claims, 15 Drawing Sheets

9
50
9
15
10
40
28
27
16
31
9
21
25

31
32
21
9
23
9
42
43
14
44
11
22
28
271
13
41
40
50
21
9
32
23
43
42
11
9
31
28
25
27
26
10
16
15

32
50
42
43
14
21
9
23
9a
23a
11
51
22
28
271
13
27

44
41
50
40
21
9
32
23
43
42
11
32
31
28
25
27
26
10
16
15

982
98
983
981
984
991
97
96
962
96
971
96
962
96
963
963
991
93
94
94
92
931

982
984
98
983
981
984
991
97
96
962
96
971
97
96
962
96
963
963
991
93
94
94
92
931

FIG.16
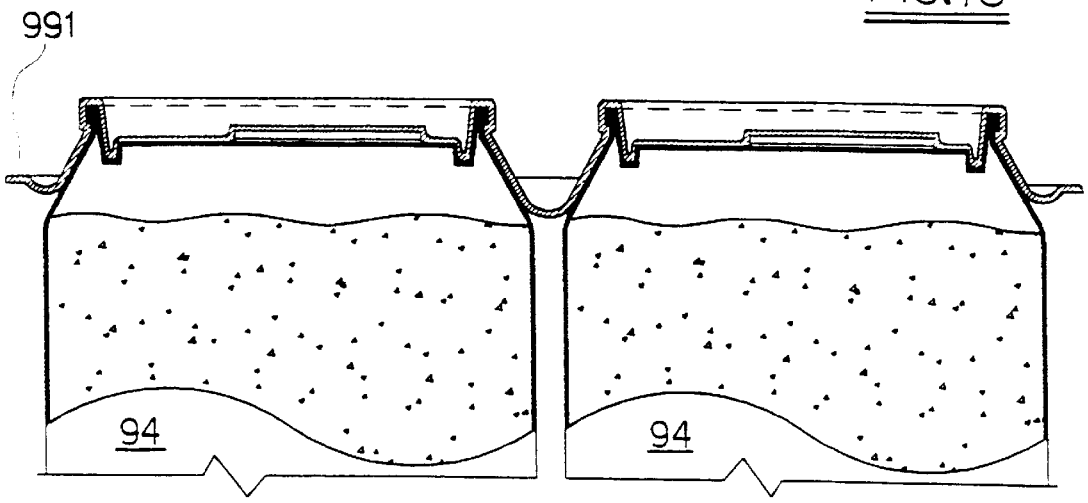
FIG.18
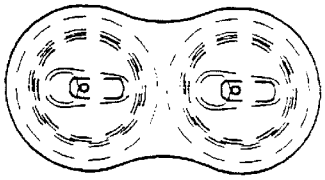
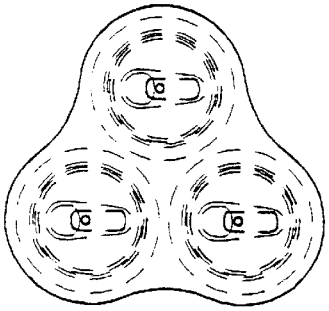
FIG.19
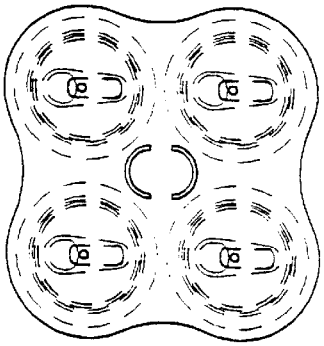
FIG.20

METHOD AND APPARATUS FOR PROVIDING HYGENIC PROTECTION ON CANS OR GROUPS OF CANS

This application is the national phase under 35 U.S.C. §371 of prior PCT International Application No. PCT/EP97/03716 which has an International filing date of Jul. 9, 1997 which designated the United States of America.

DESCRIPTION

Method and apparatus for capping, individually or in groups, container cans for food products and drinks, and cans or groups of cans capped in this manner.

BACKGROUND OF THE INVENTION

1. Technical Field

The present invention is directed to the hygienic protection of container cans for food products and drinks, and in particular drink cans having in their upper end a tear-off opening through which the drink is consumed, possibly by bringing the can direct to the mouth.

2. Background Art

The widespread practices of conserving drinks in cans has raised the general problem of safeguarding the health of the user. In this respect, after being filled, the cans are transported and stored without it in practice being possible to protect them from dust or other more dangerous contaminants, making the consumption of the liquid highly anti-hygienic whether the liquid is poured into a tumbler, or, much more serious, whether the user drinks it directly from the can.

The situation is further aggravated by the appearance of cans in which the opening tab is not pulled off, but instead bent down into the interior of the can, into direct contact with its contents.

The U.S. Pat. No. 5,088,269 discloses a method and an apparatus in which a film of thermoformable plastic material is applied to the tops of a plurality of cans.

The portions of the film overlying the top of the cans are softened by heating limited to the areas in alignment with the tops of the cans but smaller than the can tops.

The unsoftened areas of the film surrounding the softened areas are pushed in direction of the tops of the can and snap beneath the rim of the can lops, providing a cover which does not mate with the upper surface, or lid, of the can but is stretched at a distance therefrom resting on the rim.

The areas of the film distant from the lid are exposed to breakage while the cans are transported and stored, and the air contained in the sealed chamber under the film is subjected to condense and gives rise to highly anti-hygienic mildew.

The method and the apparatus of U.S. Pat. No. 5,008,269 do not fully satisfy the requirement of avoiding contamination.

There is therefore the need to protect the can upper end containing the opening tab from dust and other contaminants

SUMMARY OF THE INVENTION

Accordingly, an object of the present invention is to rationally satisfy the aforesaid requirement without substantially affecting the calming cost.

A further object of the present invention is to provide packaging means for at least two cans arranged to provide packs of at least two cans held together by a single support sheet, while at the same time protecting their lids from contamination.

The present invention is based on the solution of directly forming on the upper portion of the can, by basically using this as a forming die, a cap of food-quality plastic material which "hermetically" covers this upper portion.

The method of the present invention comprises heating a film of thermoformable plastic material and positioning it on the upper portion of the can, then making it adhere to the surface of said upper portion by exacting the air contained between this surface and the film. Finally, the film portion adhering to the can upper portion is separated from the rest of the film. During the described procedure, the film is heated to a suitable temperature such that the film is able to satisfy the conditions for thermoformability, after which, by hardening following cooling, it adheres intimately to the surface which it covers, and retains its shape.

A cap is obtained and formed from a film portion which mates with and covers the surface of the upper portion of the can.

This cap, which can be easily and rapidly removed by the consumer, covers, and effectively and hermetically protects, from dust and any other contaminant, the region comprising the can opening and the entire can upper part and upper edge contacted by the lips, thereby maintaining this region in a positively hygienic condition.

Moreover, after the can has opened, the same cap can be further used to close the can and hence prevent accidental contamination by foreign bodies. The cap forming procedure is very rapid and does not retard the production rate of the canning line in which it is inserted.

Moreover the apparatus required for effecting the procedure is relatively very simple and of low cost.

BRIEF DESCRIPTION OF THE DRAWINGS

The merits and the constructional and functional characteristics of the present invention will be apparent from the detailed description given hereinafter of two preferred embodiments thereof given by way of non-limiting example and illustrated in the figures of the accompanying drawings.

FIG. 16 is a section through a pack of two cans resulting from the preceding operations.

FIGS. 18 to 20 are views from above showing packs respectively of two, three and four cans obtained by the apparatus of the invention.

DETAILED DESCRIPTION OF THE INVENTION

Figure 1:
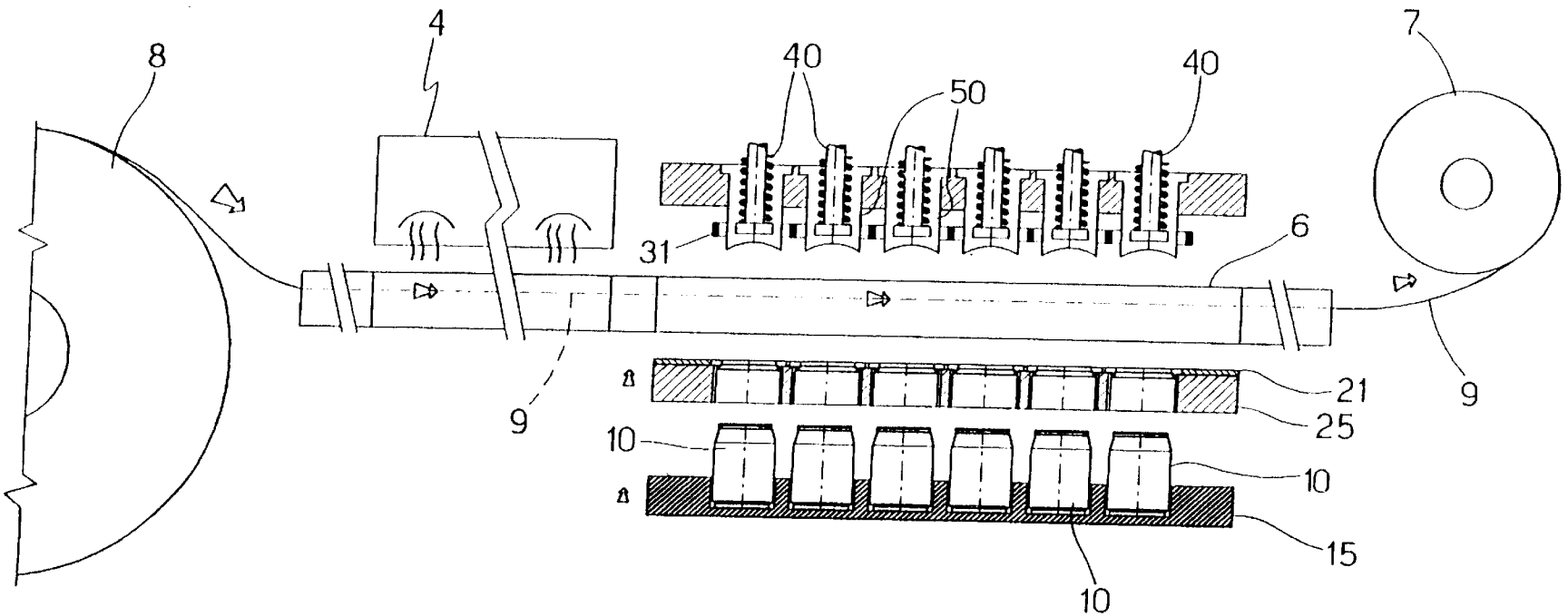
FIG. 1 is a section through the apparatus of the invention taken on a longitudinal vertical plane.

An apparatus and relative method for capping individual cans are described hereinafter with reference to FIGS. 1 to 8.

The can, indicated by 10 in the figures, is of known type. Specifically, it comprises an upper portion 11 formed from the substantially flat top end 12 of the can, its upper frusto-conical neck 13 and the circular rim 14 which joins the end 12 to the neck 13 (see specifically FIG. 3).

The illustrated apparatus comprises a backing plate 21 with a plurality of circular through apertures 22, each of which can receive with slight clearance the upper portion 11 of a relative can 10.

Specifically, each aperture 22 is defined by a ring 23 positioned in a seat 23*a* in the plate 21 and forming an integral part of the plate, to act as an "adaptor", ie it is changed for different can diameters (FIGS. 6, 6A, 7, 7A).

The plate 21 is carried by a lower support plate 25 having a plurality of circular through apertures 26, each of which is positioned coaxially to a respective aperture 22 and is arranged to house with slight clearance that can portion below the upper portion 11.

Each aperture 26 is defined by a sleeve 27 positioned in a seat 27*a* in the plate 25 and forming an integral part of the plate, to act as an "adaptor", ie it is changed for different can diameters. The plurality of cans 10 on which the apparatus of the invention operates during each cycle are carried by a loader tray 15 provided with a corresponding plurality of seats 16 housing, as virtually an exact fit, the lower portions of the cans 10. The seats 16 are geometrically arranged relative to each other so as to be coaxial to the apertures 22. The loader 15 is subjected to movement means (of known type, not shown) which arrange the plurality of cans 10 in correspondence with the apertures 22, such that the can upper portions 11 project beyond the upper surface of the plate 21.

Above the plate 21 there is positioned a grid 31 comprising a plurality of walls 32 having their numerous lower edges facing downwards to define a corresponding plurality of apertures. Each of these apertures is arranged to coaxially surround a corresponding aperture 22 in the backing plate 21, the lower edge of the walls 32 being able to be lowered into contact with the upper surface of the backing plate 21.

Above the upper portion 11 of the cans and below the grid 31 there is positioned a web of undefined length of a film 9 of thermoformable, plastic material of a type suitable for foods, such as HiPS, PP, PET, PVC, PE or PS.

The film web 9 is unwound from an initial reel 8 and is wound (as scrap) onto a final reel 7, it being kept guided by suitable means (shown schematically in FIG. 1).

The grid 31 is moved by means (of known type, not shown) which press it against the upper surface of the backing plate 21, with the film 9 interposed.

To the upper end of each sleeve 27, on its inside, there is fixed a gasket 28 arranged to make contact with the lateral surface of the can 10, in particular with its frusto-conical neck 13, to produce a seal during the suction stage. In addition, the upper end of the sleeve 27 forms radial channels 271 (FIG. 6A) which, together with small radial ducts (not shown in the figures), connect that region surrounded by the apertures 22 to pump means (not shown in the figures) for drawing air from said region (as further described hereinafter).

Above the plate 21, within the apertures defined by the grid 31, there are positioned a like number of presser means 40, having a vertical support shank 41 to which there is lowerly fixed a plate 42 carrying a lower layer 43 of yieldable material, with which it presses against the upper end 12 of the can 10. Springs 44, positioned about the shanks 41, provide the downward force with which the pressers 40 press on the can 10.

Above the plate 21 there are positioned a plurality of cylindrical blades 50 (or punches), each positioned coaxially about a respective presser means 40 and driven in a vertical direction by known means, not shown in the figures. The cutting edge 51 of each blade 50 faces downwards and has a closed contour arranged to pass about the upper end 12 of the can 10 and to skim the upper edge of the aperture 22 so that in combination with this edge it cuts the film 9 (as further described hereinafter).

The aforedescribed apparatus implements the following procedure. At the commencement of each capping cycle, a plurality of cans 10 are loaded onto the loader 15. Which is positioned below the plates 21 and 25 (FIG. 1). In the meantime the grid 31, the pressers 40 and the blades 50 are raised to be spaced from the plate 21. A hole-free continuous portion of the film 9 is heated by heater 4 located upstream of the plate 21, and is immediately afterwards advanced to a position above the plate 21. Advantageously, the heater 4 are infrared radiation means for, heating a portion of the film 9 to a temperature of between 120° C. and 230° C. according to the polymer type.

At this point the loader 15 is raised to position the upper part of the cans 10 through the apertures 22 and 26, and urge them slightly upwards to press their neck 13 into contact with the respective gaskets 28. When in this position the upper portion 11 of the cans projects slightly beyond the upper surface of the plate 21.

Figure 2:
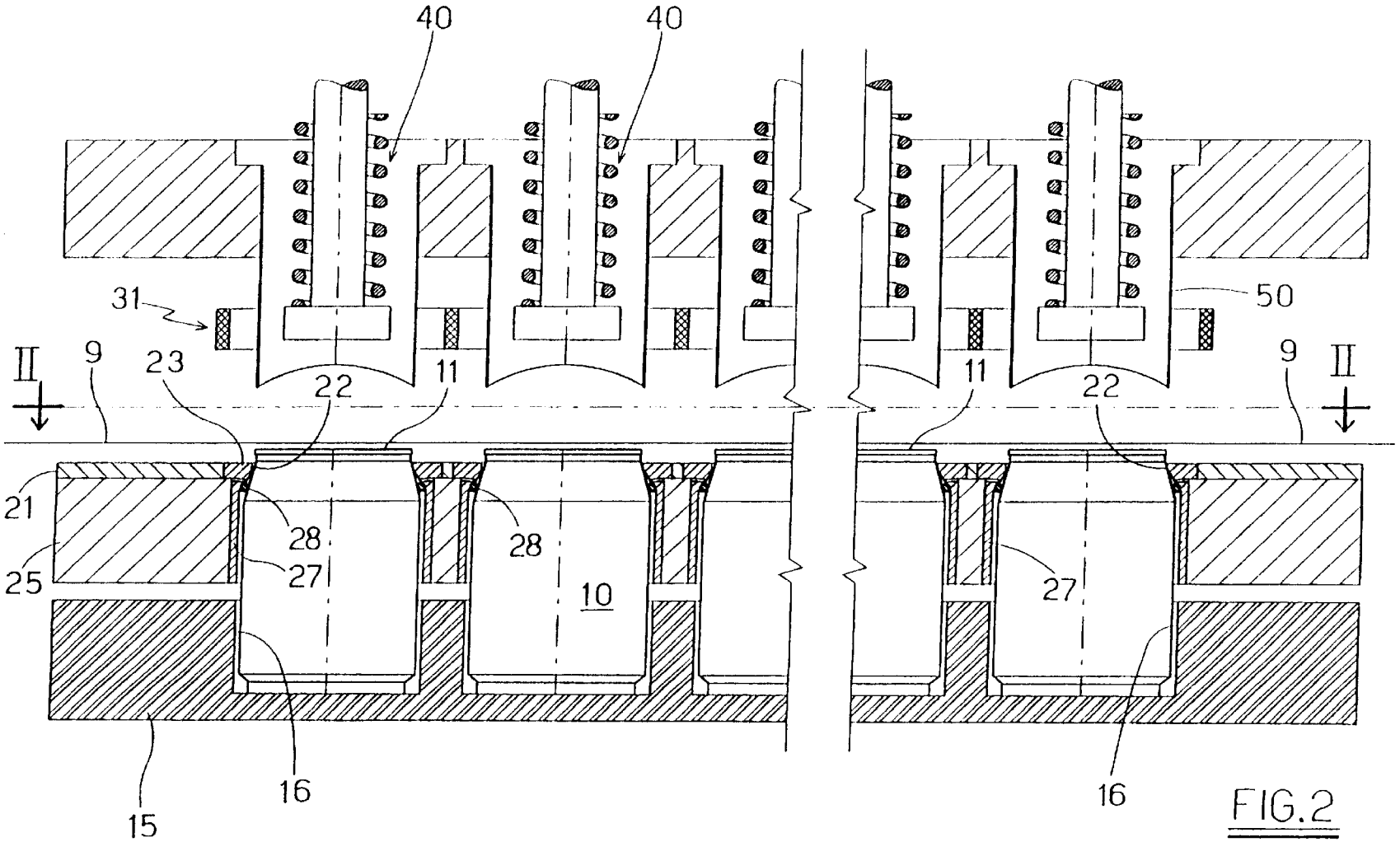
FIGS. 2 to 5 show an enlarged detail of FIG. 1, in successive stages of the method of the invention.
Figure 2A:
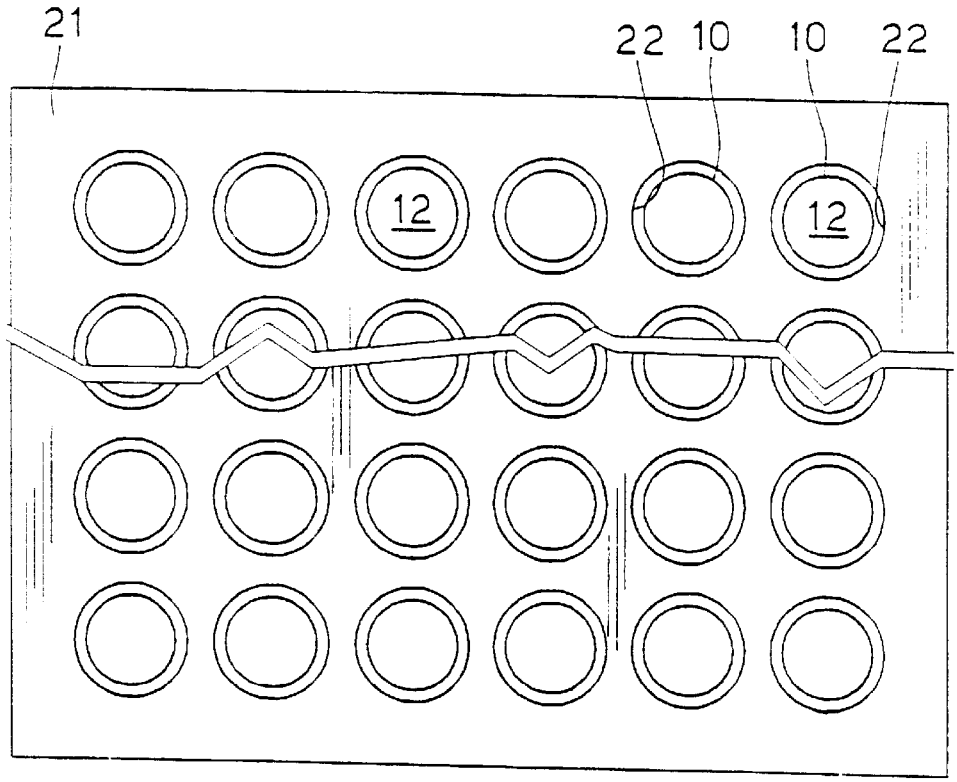
FIG. 2A is a section on the plane II—II of FIG. 2.
Figure 8:
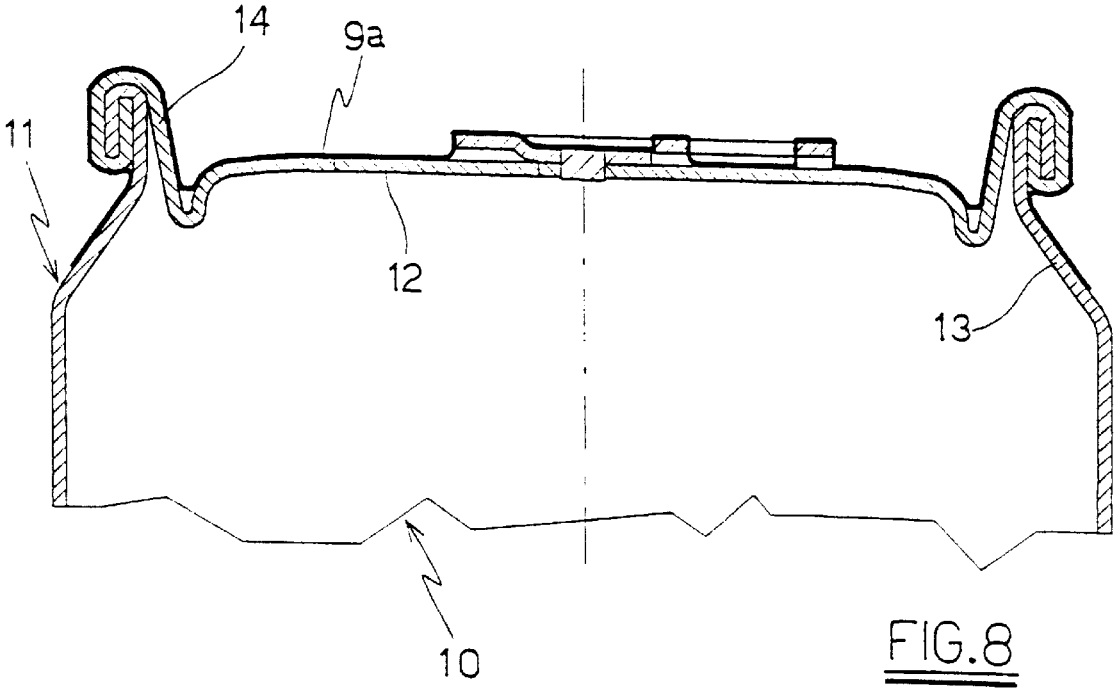
FIG. 8 is a section through the upper portion of the capped can.
Figure 3:
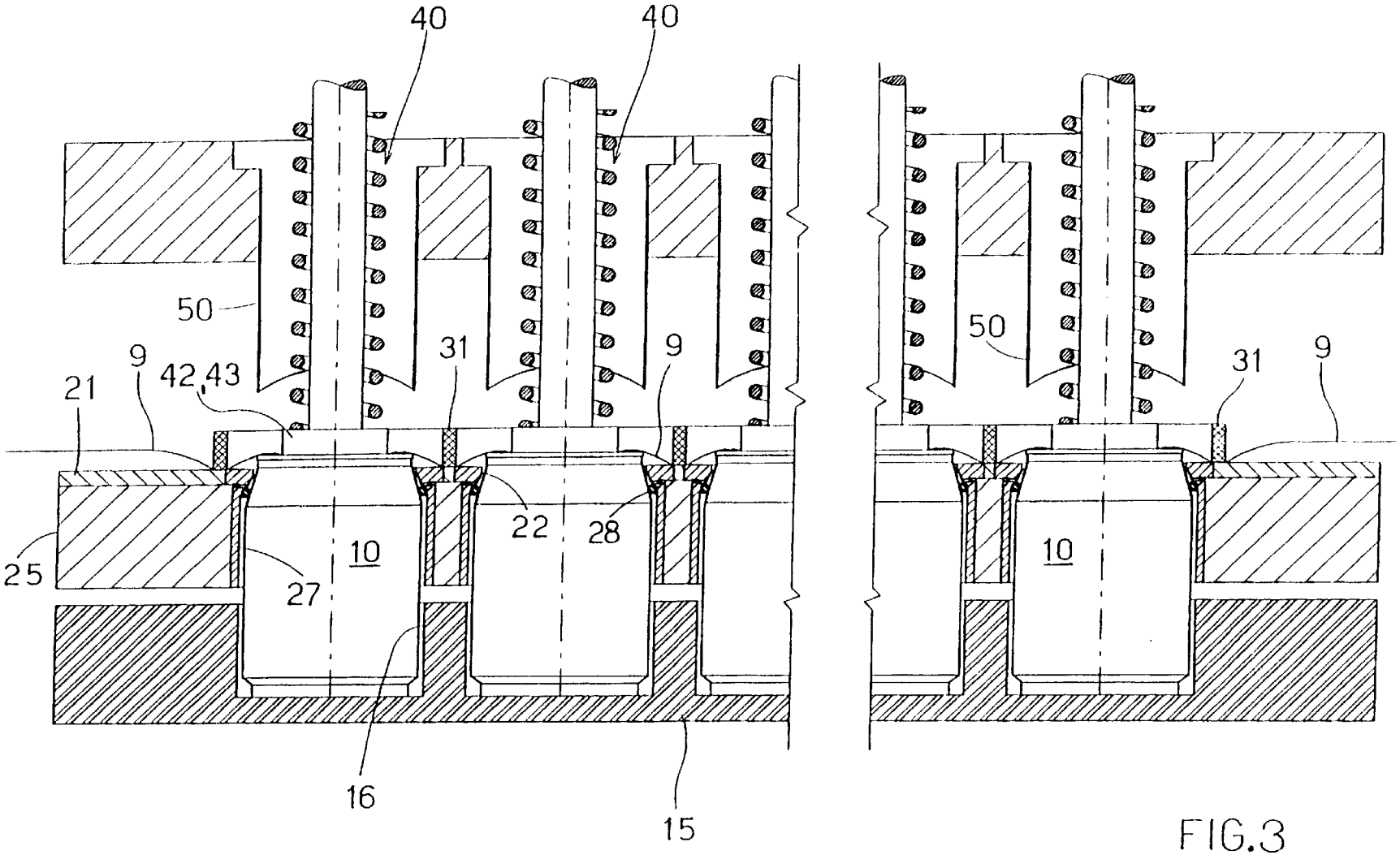
Figure 4:
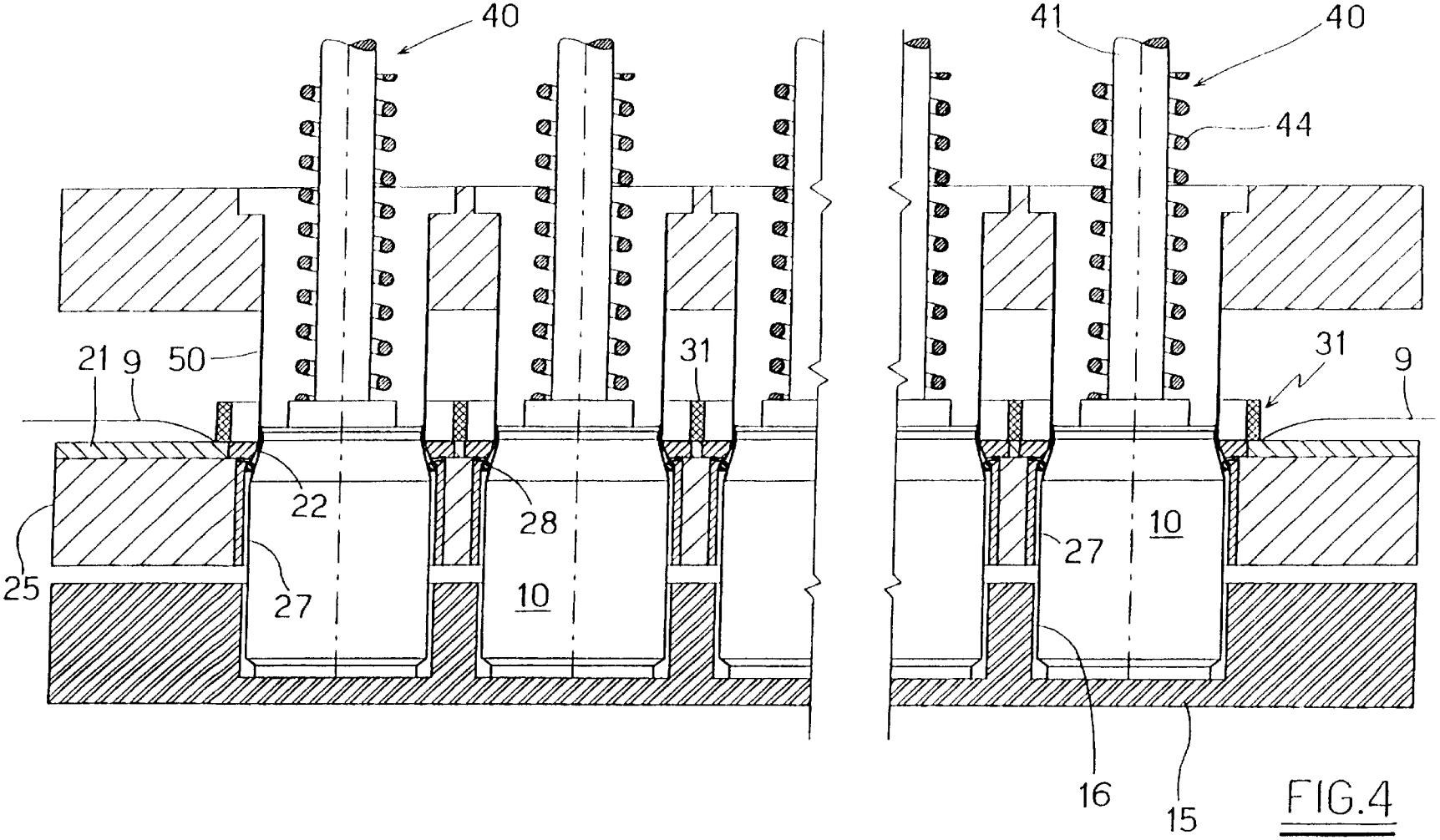

The combination of the loader 15 and plates 21 and 25 is then moved upwards so that the upper end 12 of the cans skims the film 9 (FIG. 2).

In the next stage (FIG. 3) the grid 31 and (virtually simultaneously) the pressers 40 are lowered to press the heated portion of film 9 against the upper end of the cans 10 and against the upper surface of the backing plate 21.

The lower edge of the walls 32 presses on the film 9 against the upper surface of the plate 21, to create a circular seal strip through which air does not pass.

Consequently, in correspondence with each aperture 22 an interspace is formed between the film 9 and the can upper portion 11, which is isolated from the external environment. In detail, this interface is bounded lowerly by the surface of the can upper portion 11, as far as the point in which this is in contact with the gasket 26. Upperly it is bounded by that portion of film 9 surrounded by the lower edge of the walls 32, by that part of the upper surface of the plate 21 (ring) surrounded by said edge of the walls 32, and by the inner surface of the apertures 22. Lowerly, this interspace is bounded by the gasket 28.

During this stage, the air present in the interspace is extracted through the channels 271 and the other channels (not shown) by said pump means, and consequently the portion of film 9 surrounded.

By the wall 32 adheres hermetically to the outer surface of the can upper portion 11 (and also to the upper surface of the ring 23) to give rise to a cap 9*a,* which for the moment is still joined to the remaining part of the film 9, but exactly matches the form of the upper portion 11.

This adhesion action is further aided by the pressers 40 and the yieldable layer 43 which presses the film against the upper end 12

Figure 5:
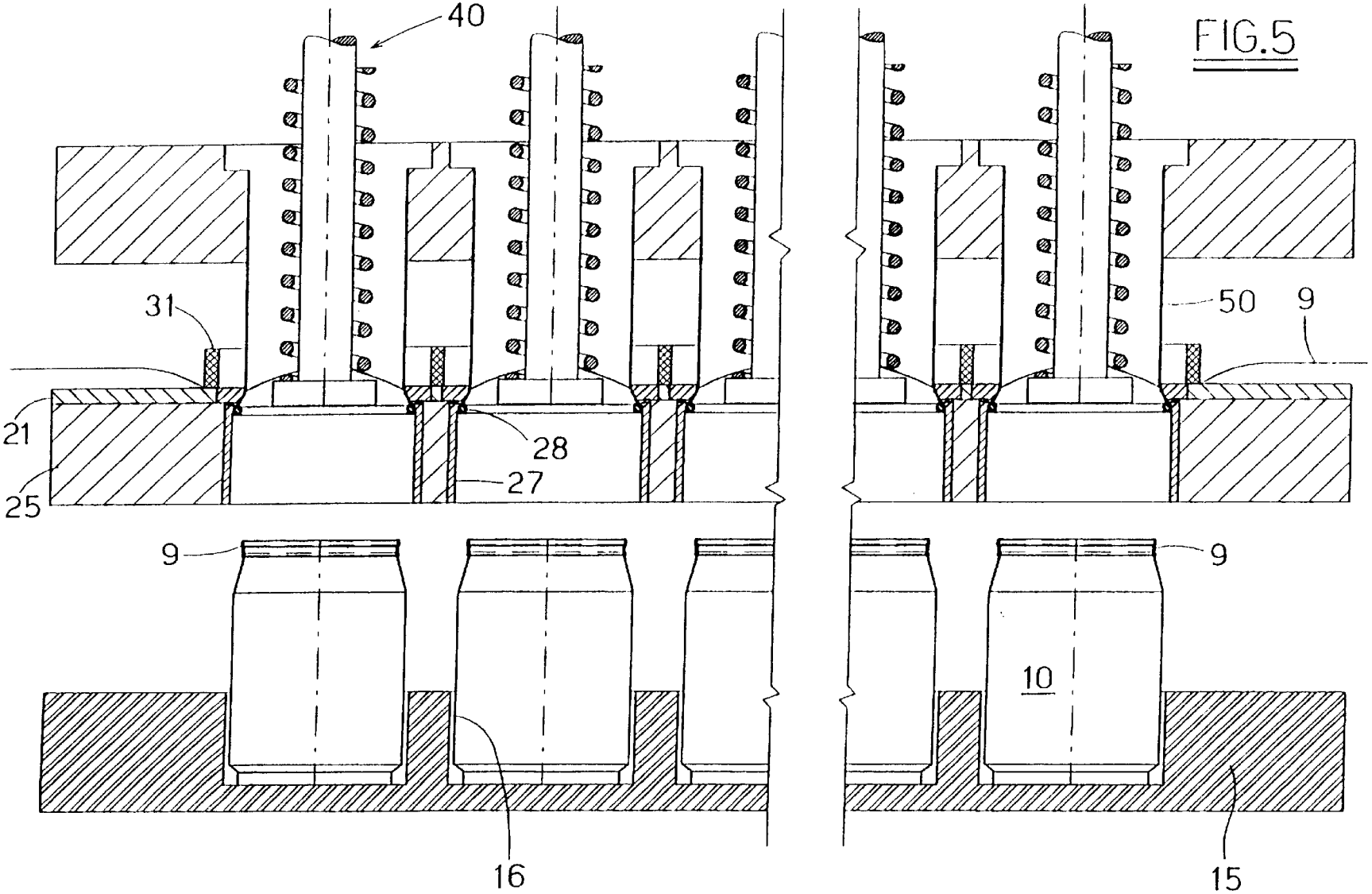
Figures 6, 6A:
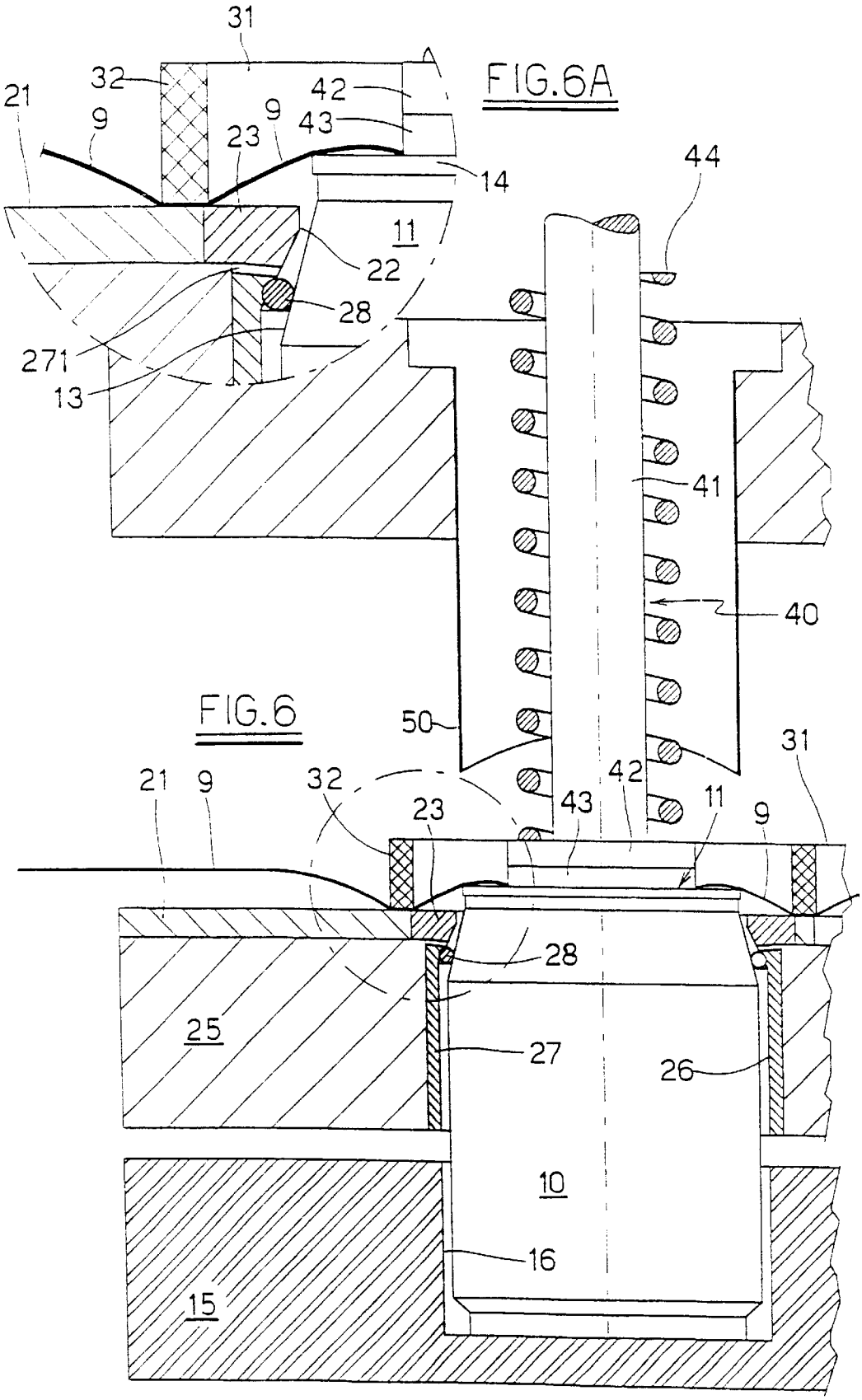
FIG. 6 is an enlarged detail of FIG. 3.
FIG. 6A is a further enlarged detail of FIG. 6.
Figures 7, 7A:
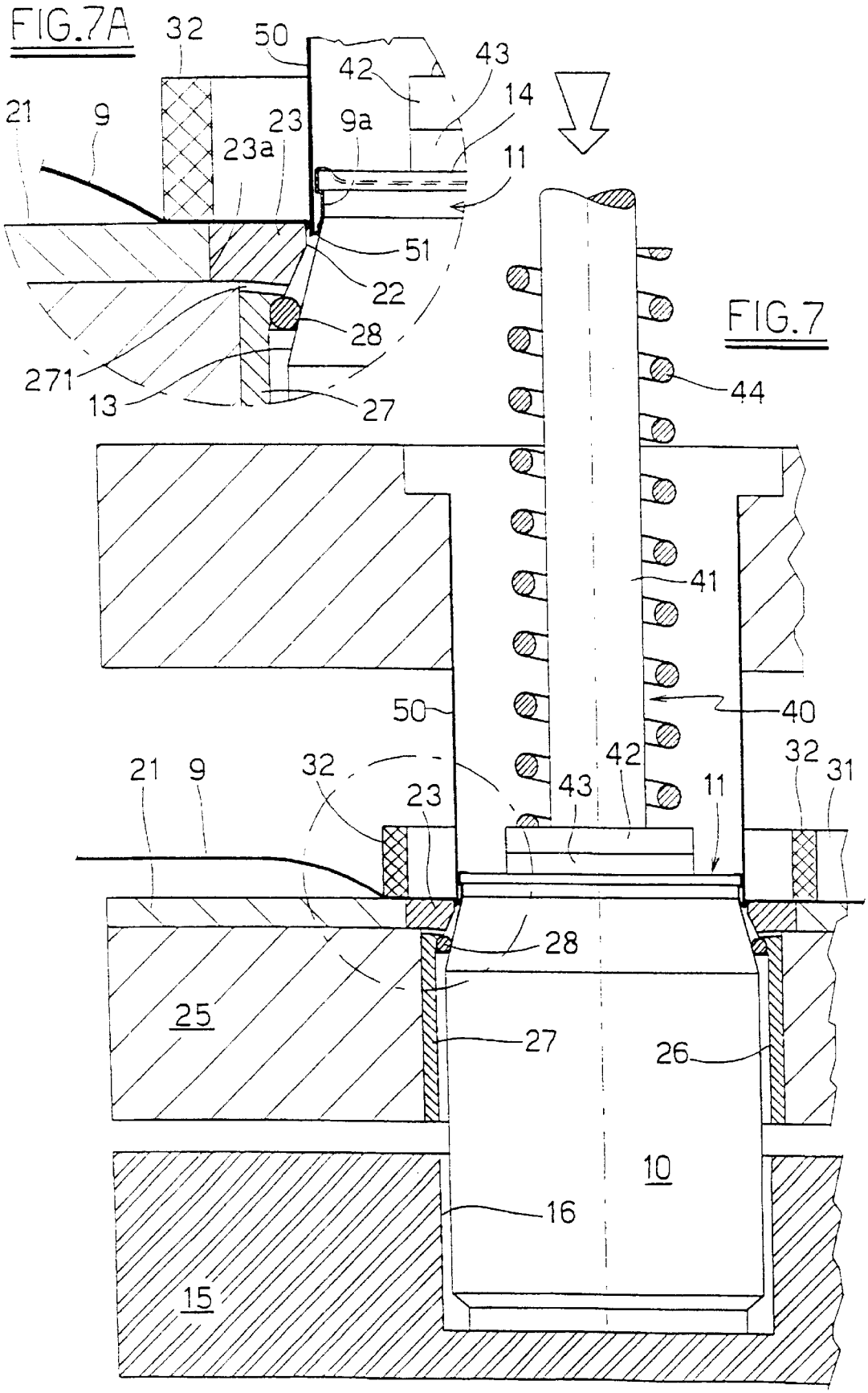
FIG. 7 is an enlarged detail of FIG. 4.
FIG. 7A is a further enlarged detail of FIG. 7.
Figure 9:
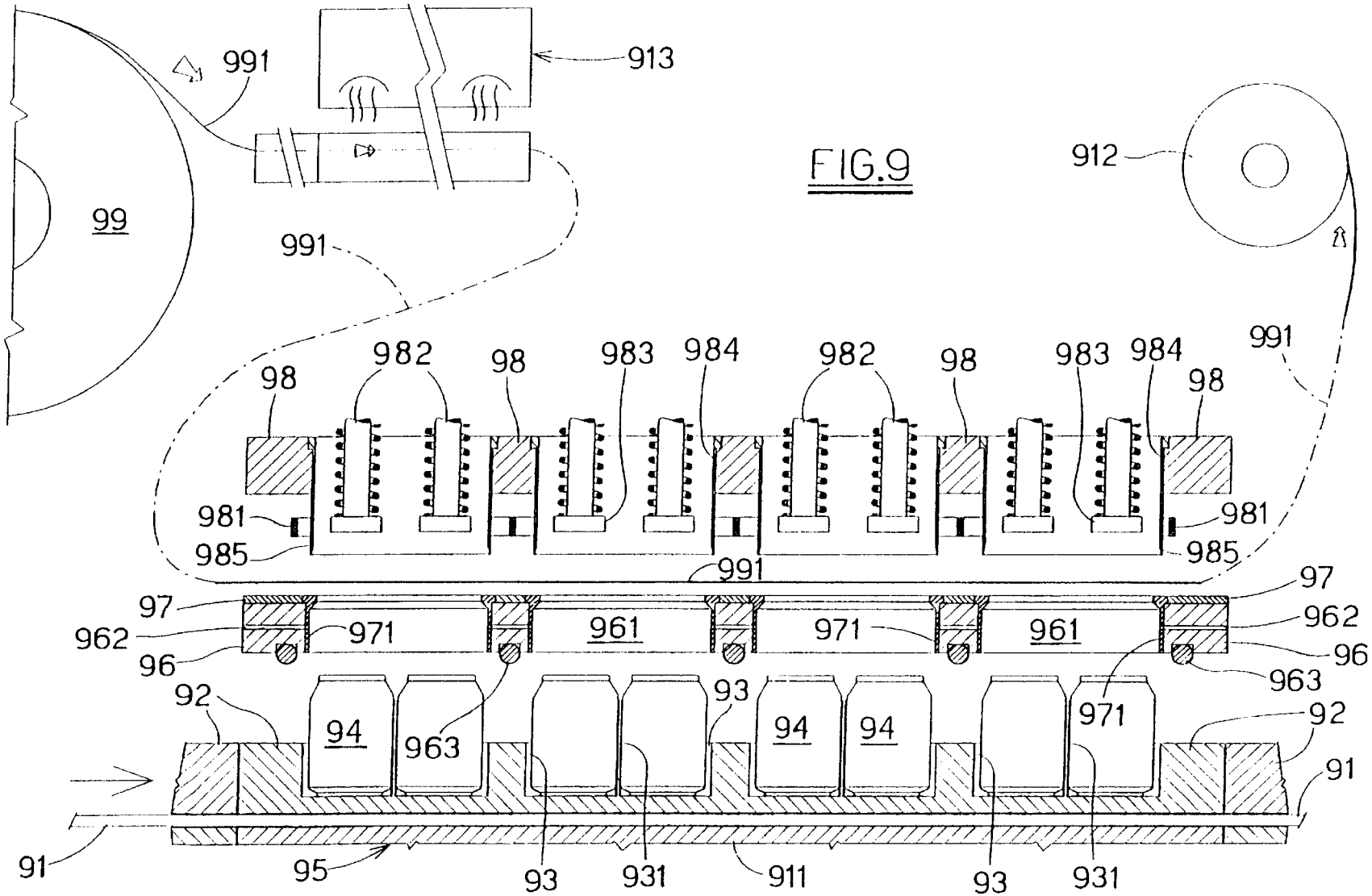
FIG. 9 is a partly sectional schematic side view of a further embodiment of the apparatus according to the invention.

In the next stage (FIGS. 4, 7 and 7A), the blades 50 are lowered to graze the upper edge of the apertures 22 with their cutting edge 51, and then produce a corresponding closed circular cut in the film 9, to separate the film portion adhering to the can 10 (cap 9*a*) from the remainder of the film 9. The cans 10 are then lowered by lowering the loader 15 and aided by the pressers 40 which press downwards against the cans, are finally removed (FIG. 5). The grid 31, the blades 50 and the pressers 40 are raised away from the plate 21, and the described cycle recommences to cap further cans. On cooling, the cap 9*a* completes its hardening against the surface of the upper portion 11, to adhere to and exactly mate with its outer form, and them permanently retains this assumed shape.

Moreover, the cap 9*a* adheres under vacuum to the can surface, hence covering it hermetically to securely protect it from any external contaminant. With reference to FIGS. 9 to 20, the method and apparatus for capping groups of cans will now be described.

The figures show a conveyor 91 driven stepwise, and on which equidistant trays 92 are arranged in succession.

Figure 17:
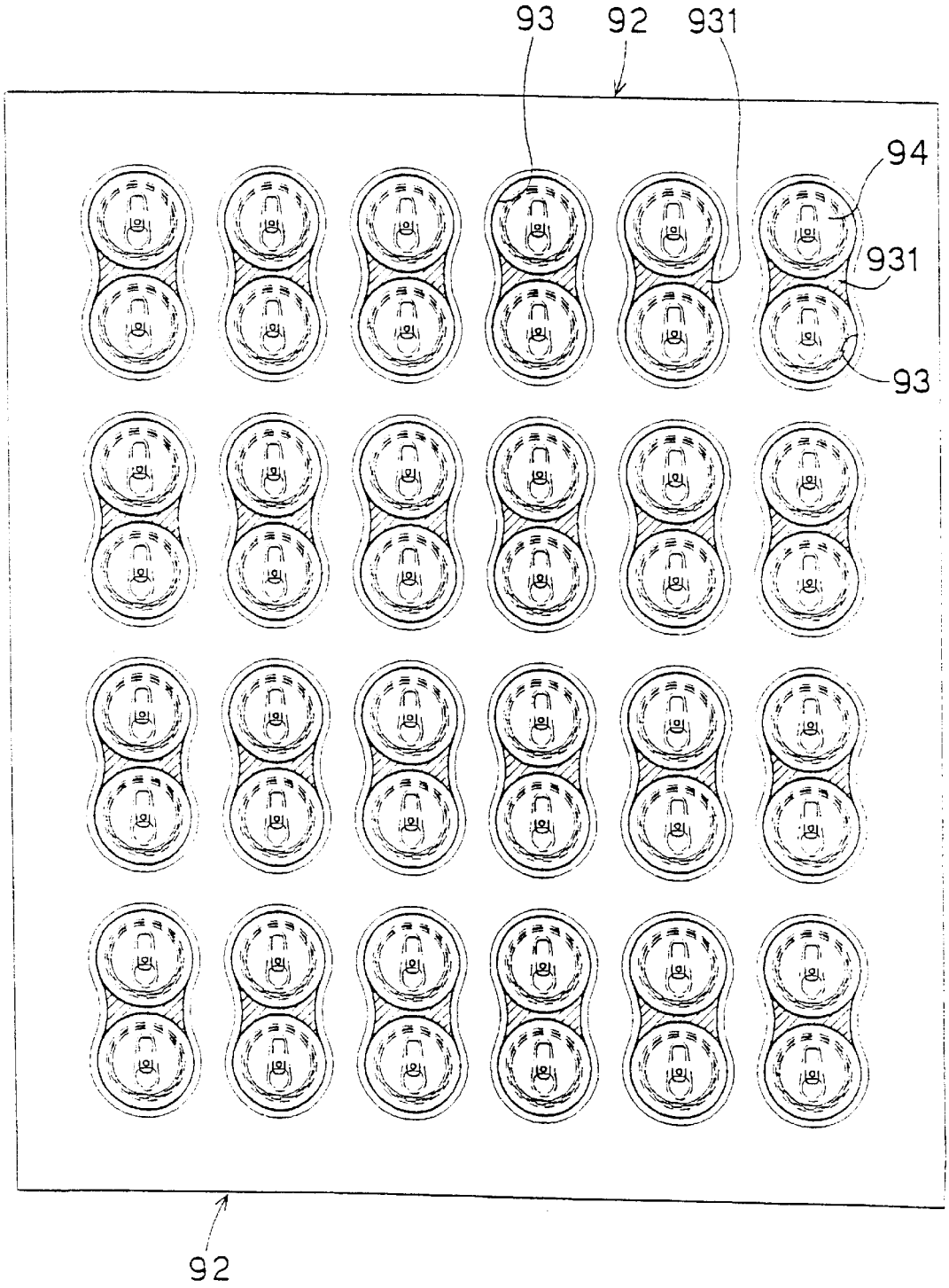
FIG. 17 is a view from above showing the can-containing tray illustrated in FIG. 9.

The trays 92 are best seen in FIG. 17, and comprise a base with uniformly distributed recesses 93 for receiving a group of cans 94 to be formed into a pack.

More precisely, each recess 93 has in plan view a shape representing the envelope of the group of cans, and from its base there upwardly extend paritioning baffles 931 occupying the space which would otherwise remain free between one can and the next, said baffles having a height equal to the height of the cylindrical part of the cans.

The conveyor belt 91 carries the trays to a processing station 95, where it is supported by an underlying support surface 911.

Above the station 95 there is a first vertically movable plate 96 having in plan view the same shape as the underlying tray 92 and comprising through apertures 961 which correspond to the recesses 93 and have the same shape as these latter.

Alternatively the clamping plate 96 is fixed, and that conveyor portion supporting the tray 92 is movable to raise the tray to below the clamping plate. The plate 96, which will be called the backing/centering plate, comprises channelling 962 communicating with a vacuum vessel or vacuum pump, neither shown, and a lattice of gaskets 963 which surround the through apertures 961.

To the plate 96 there is upperly fixed a thin steel blade 97, which is perforated as the plate 96 and is provided with hardened sleeves 971 positioned to circumscribe each of the through apertures 961.

The plate 96 and relative blade 97 are overlaid by a second vertically movable plate 98 carrying the operating means described hereinafter.

A film pressing grid 981, movable relative to the plate 98, is fixed to the lower side of the plate 98 and, when lowered, rests on the blade 97.

The plate 98 also carries a series of shanks 982 which are provided with a base disc 983 and are coaxial to the seats defined by the underlying recesses 93 and baffles 931 so that each of the discs 983 is able to descend and press against the lid of a can 94.

The shanks 982 are introduced through apertures 984, conjugate with the underlying apertures in the centering plate but slightly wider than these latter.

Each of the apertures 984 carries a downwardly projecting cylindrical blade 985 having a closed contour circumscribing at a short distance therefrom the edge of the through apertures 961, and arranged to interact with the sleeves 971 of the blade 97.

Figure 14:
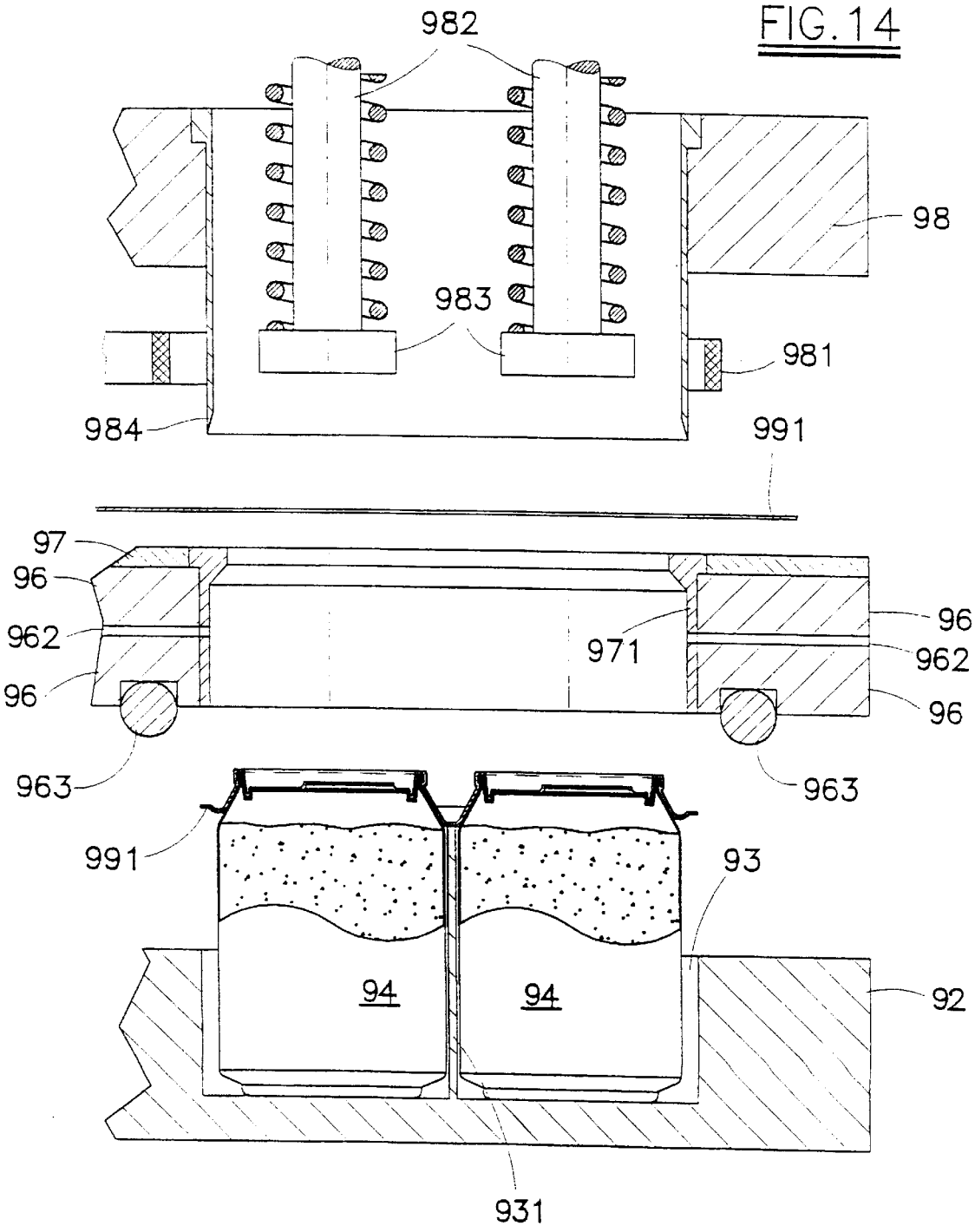
FIG. 14 shows the detail of FIG. 10 in the next operating position to that of FIG. 13.

In the embodiment shown in FIG. 14 the blade 985 rests on the sleeves 971.

Figure 15:
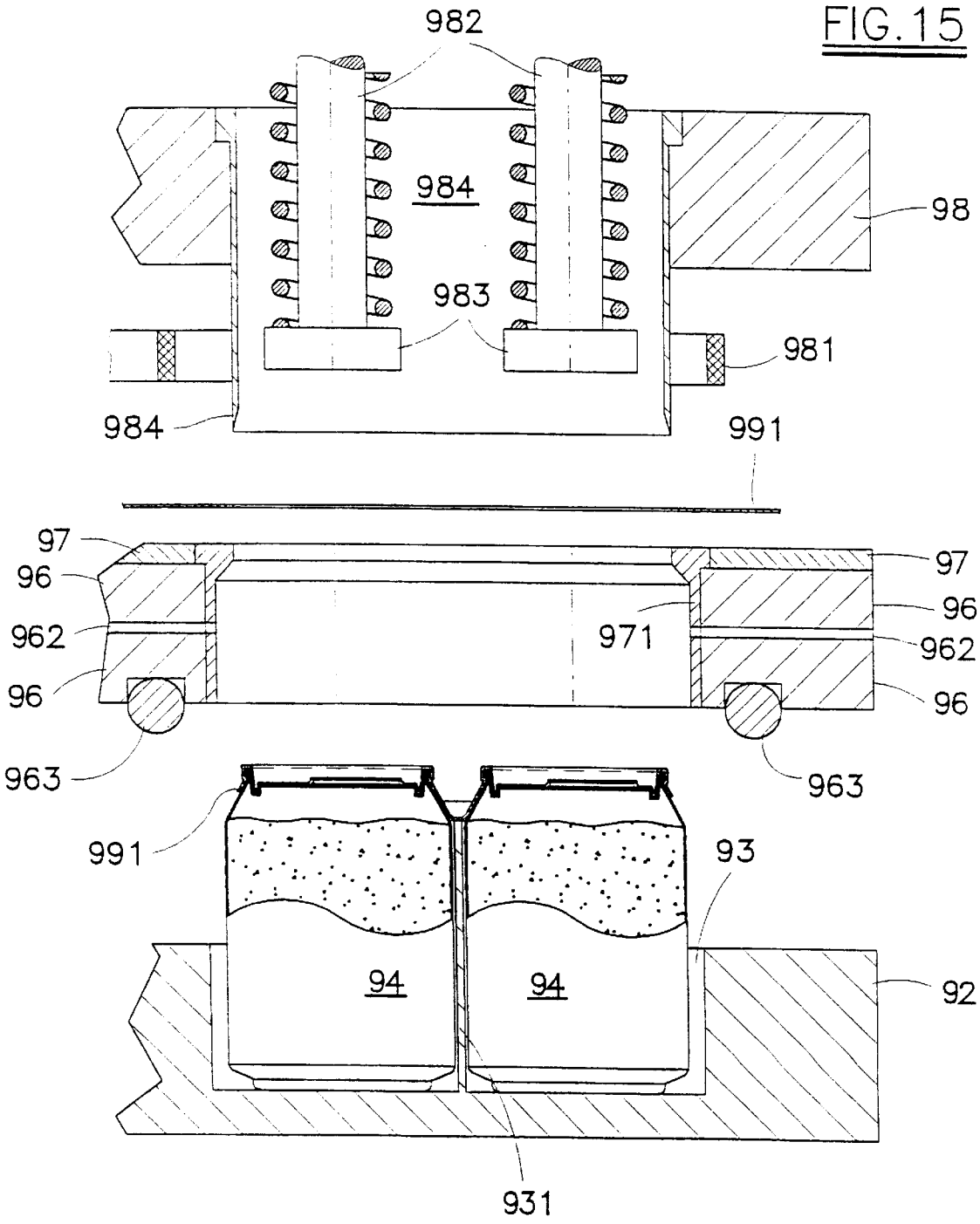
FIG. 15 is similar to FIG. 14, but with a different type of cutting blade.

If the film 910 is substantially rigid so as to hinder can removal or cause separation of the shaped film portion which caps the cans, the embodiment shown in FIG. 15 is Preferable, in which the blade 985 enters the sleeve 971 as an exact fit, to act as shears.

The apparatus also comprises a device carrying a reel 99 of thermoformable film 991.

After unwinding from the reel 99 the film passes through the station 95 immediately above the blade 97 and is rewound as scrap on a reel 912 positioned downstream.

A tunnel 913 for heating the film 91 is provided between the reel 99 and the station 95.

The aforedescribed apparatus is able to implement the following method, the description of which will also clarify the operation of the apparatus.

A succession of trays 92 already carrying cans 94 in their recesses 93 are loaded onto the conveyor belt 91.

Advancement of the belt 91 is intermittent and is such that it halts with the tray positioned in the station 95, with the recesses 93 always perfectly aligned with the through apertures 961 of the overlying centering plate 96.

Figure 10:
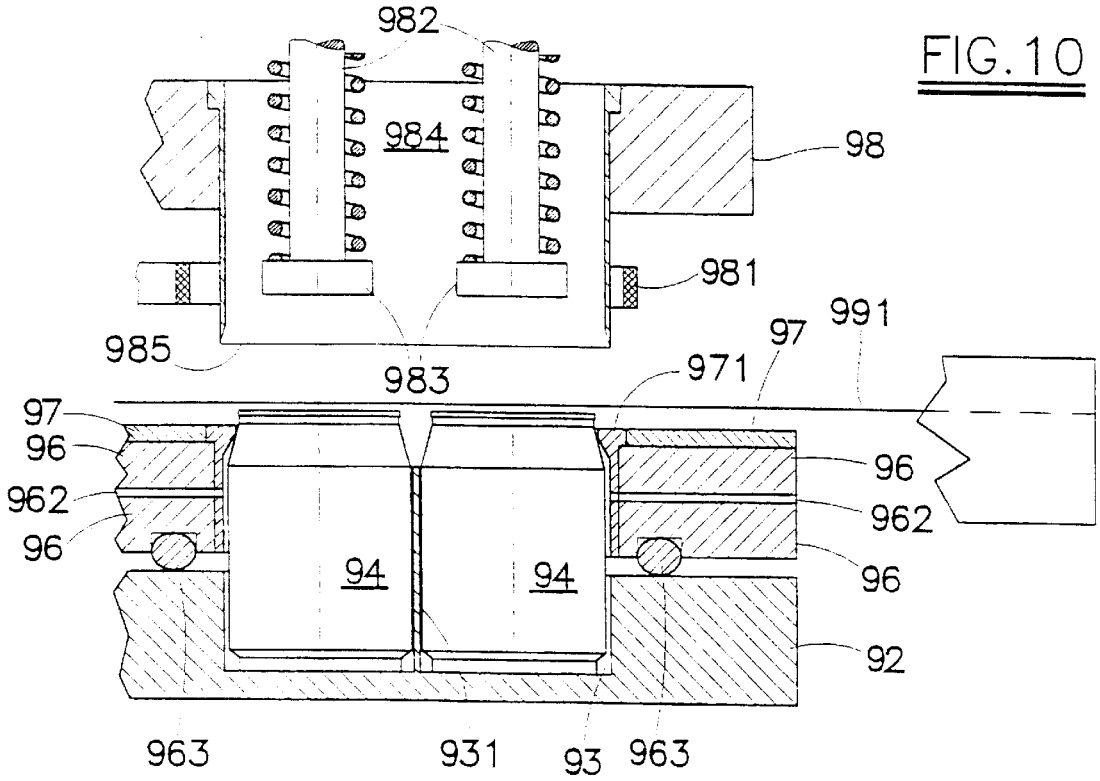
FIG. 10 is an enlarged detail of FIG. 9, shown in a subsequent operating position.

When the belt 51 halts, the plate 96 descends until it rests in a sealed manner, by virtue of the gaskets 963, on the underlying tray 92, as shown in FIG. 10.

Alternatively, as stated, the backing plate portion 911 raises the portion of the conveyor 91 to bring the tray 92 below the fixed plate 96.

Figure 11:
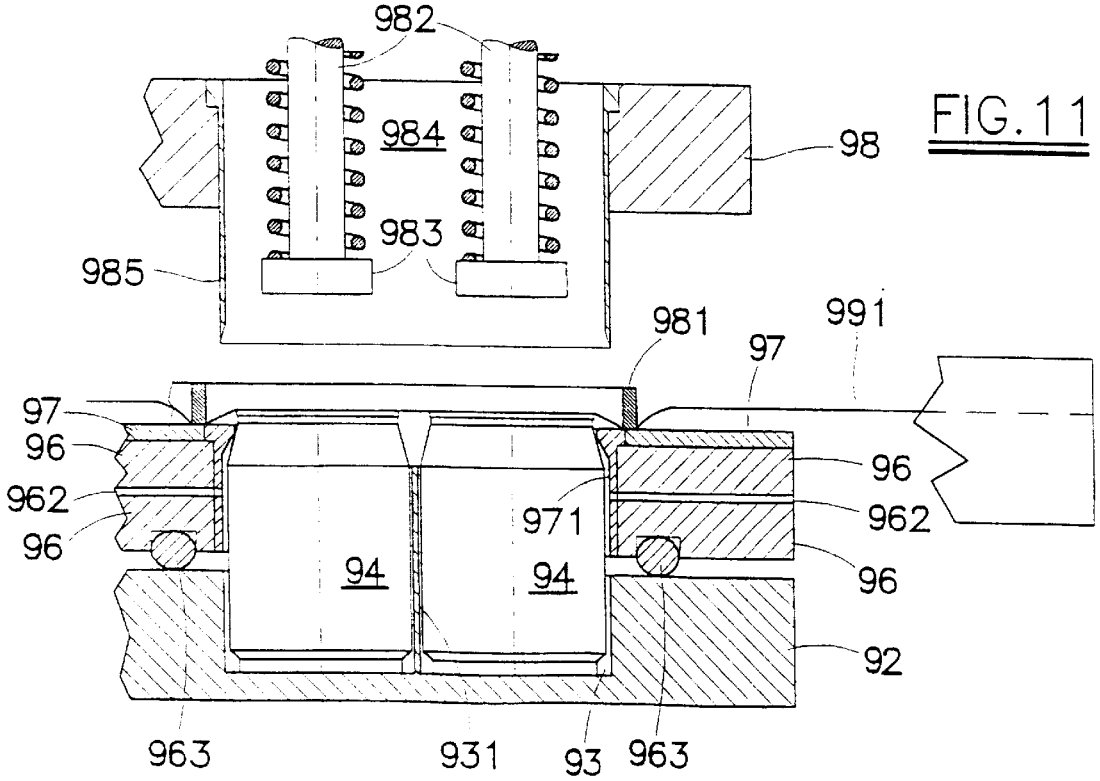
FIG. 11 shows the detail of FIG. 10 in the next operating position to that of FIG. 10.

At this point the film pressing grid 981 descends from the plate 98 to spread the taut film 91 over the end parts of the cans 94 which project beyond the blade 97 of the plate 96, as shown in FIG. 11.

Figure 12:
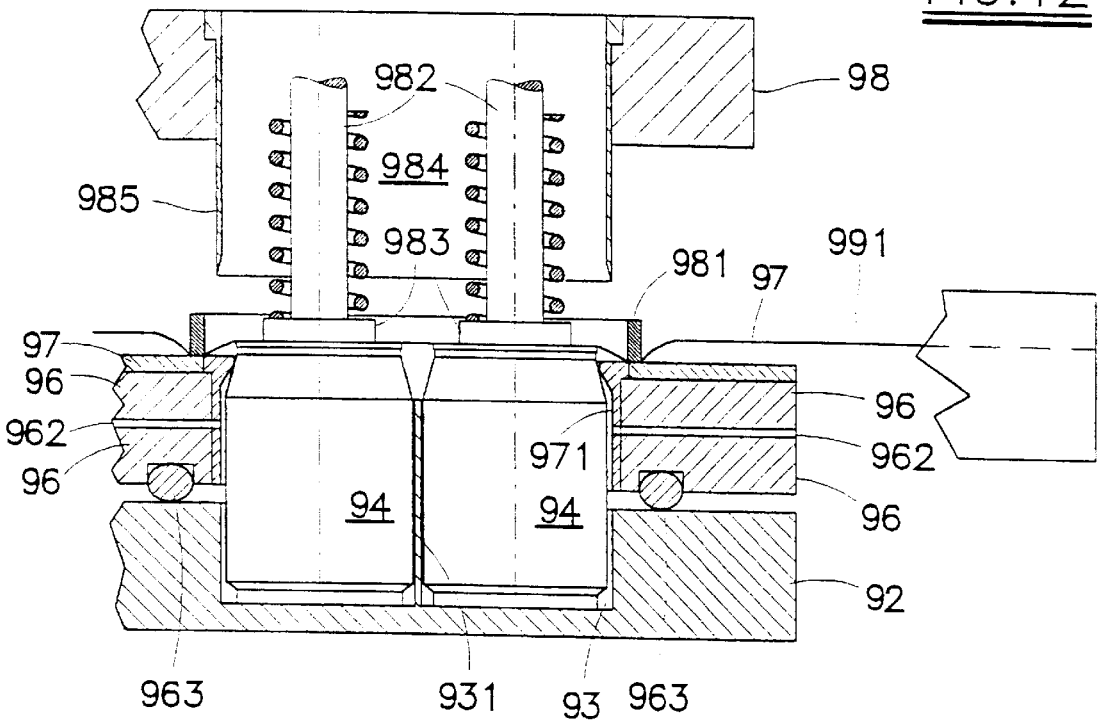
FIG. 12 shows the detail of FIG. 10 in the next operating position to that of FIG. 11.

After the descent of the grid 981, the discs 983 are made to descend to press the film onto the lid of the cans, as in FIG. 12, to cause the film 91 to perfectly adhere to the upper part of the cans, after which the connection between the channelling 962 and the vacuum chamber is opened.

Figure 13:
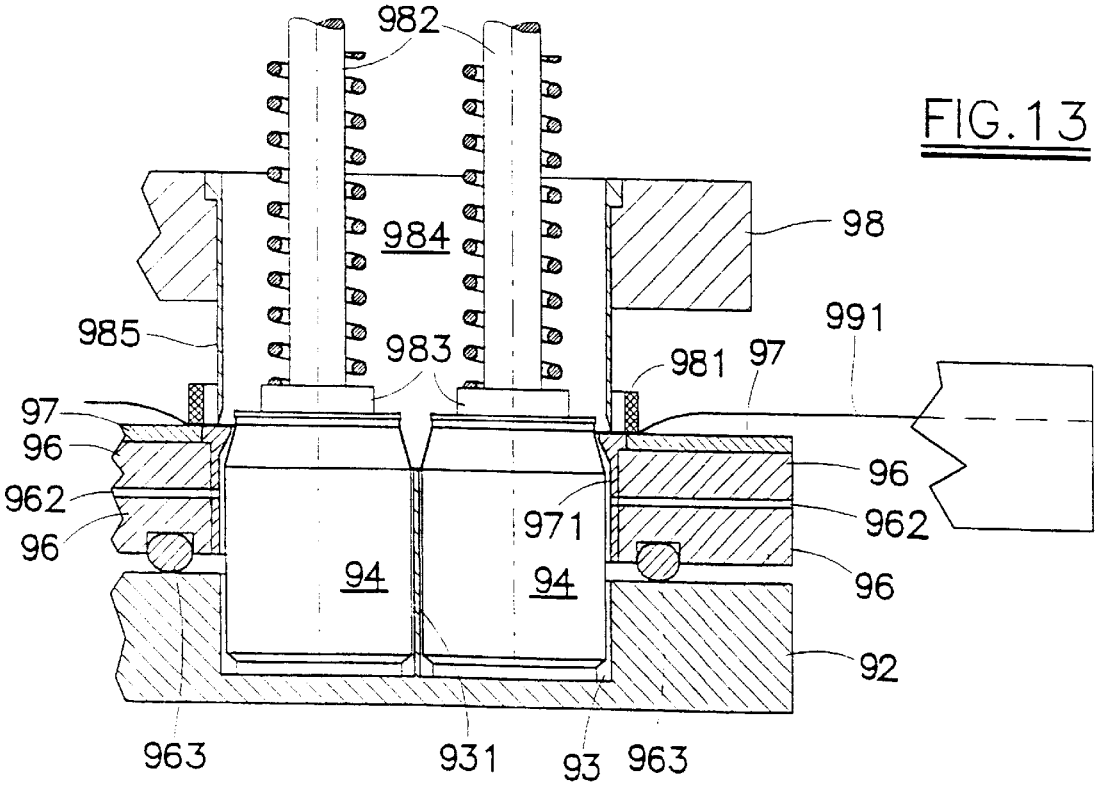
FIG. 13 shows the detail of FIG. 10 in the next operating position to that of FIG. 12.

The subsequent descent of the plate 98 with the blades 984 causes separation from the film 91 of that part adhering to the cans, as shown in FIG. 13.

On termination of the cycle, all the devices return to their initial position, as shown in FIG. 14, the cans arranged in each recess of the tray 92 being joined together by the film 91 which surrounds their end parts as shown in FIG. 15.

In the illustrated example the plate 96 and the underlying tray 92 have the shape shown in FIG. 16 for forming two-can packs. It is however apparent that the trays and the plates 96, 97 and 98 can be of any shape for forming multi-can packs, as shown in FIGS. 17, 18 and 19.

From the aforegoing it is apparent that, by virtue of the described apparatus, can group packs can be formed without interrupting the flow of the can processing line, by simply inserting the apparatus into the line.

This constitutes one of the many merits of the invention, in that the insertion into the line avoids rehandling the products for their packing and further manipulation, to the advantage of production costs.

It should also be noted that with the same apparatus, cans of different height but of equal cross-section can be packed by simply adjusting the distance between the conveyor 91 and the unit formed by the plates 96 and 98 plus relative accessories.

What is claimed is:

1. An apparatus for capping at least one container having an upper end portion formed from a substantially flat top end of the can, an upper neck and a circular rim which joins the flat top end to the neck, which comprises a carrier for advancing at least one container through the capping apparatus, means for supplying a moldable sheet into contact with the upper end portions of the containers at least one tray provided with recesses for receiving at least one container an overlying backing/centering plate containing a plurality of through apertures, each arranged to receive, with slight clearance, the upper portion of the at least one container contained in each of said recesses;

means for arranging said tray in correspondence with said backing/centering plate in a position such that the upper portion of each container contained in the tray recesses projects beyond the upper surface of the backing/centering plate;

means for softening a web of plastic film;

means for positioning the softened web of plastic film above the backing/centering plate and above the projecting upper portions of the containers;

grid means defining a corresponding plurality of apertures, each arranged to surround a corresponding aperture of the centering plate, the lower edge of said grid means being arranged to press the film against the upper surface of the centering plate;

pneumatic seal means disposed between said centering plate and said tray, said pneumatic seal means surrounding the recesses, each of which containing one container;

means for placing the chambers formed by the recesses and the overlying film under vacuum; and means for cutting the film in proximity to the outer edge of said through aperture of the centering plate.

2. The apparatus for capping containers according to claim 1, wherein each recess is arranged to receive at least two containers by being provided with a partitioning baffle which occupies the space left free between the outer walls of the containers and the inner wall of the recess.

3. The apparatus as claimed in claim 1, wherein the pneumatic seal means is an annular gasket.

4. The apparatus as claimed in claim 1, wherein the pneumatic seal means acts between the backing/centering plate and the neck of the container.

5. The apparatus as claimed in claim 1, wherein the pneumatic seal means acts between the backing/centering plate and the tray.

6. The apparatus as claimed in claim 1, wherein a yieldable pressing means is provided for pressing the plastic film against the upper end of the containers.

7. The apparatus as claimed in claim 1, a sleeve of hard material against which the film cutting means acts, is provided in correspondence with each aperture of the centering plate.

8. The apparatus as claimed in claim 1, wherein the film cutting means comprises a plurality of vertically movable cylindrical blades, the cutting edge of which faces downwards and have a closed contour arranged to circumscribe, at a short distance, the edges of the through apertures of the centering plate.

9. The apparatus as claimed in claim 8, wherein the blade cutting edge enters the sleeve to act as shears.

10. The apparatus as claimed in claim 8, wherein the blade cutting edge rests on the sleeve to act as a punch.

11. The apparatus of claim 1, wherein the neck has a frusto-conical configuration.

12. A method of capping at least one container having as an upper end portion a flat top end, a neck portion and a circular rim which joins the flat top end to the neck portion, which comprises heating a film of thermoformable plastic material to a temperature such that the film becomes plastic and moldable, positioning the film of thermoformable plastic material on the upper end portion of the container in contact with an upper border of the circular rim to define a closed chamber between said film and said upper border of the circular rim, said film adhering to said upper end portion of the container by mechanically pushing the portion of the film overlaying the top of the can against at least the central portion of the top, extracting air from said closed chamber by applying a vacuum outside the chamber to hermetically seal the container, and separating that portion of the film adhering to the upper end portion of the container from the rest of the film, whereby by hardening following cooling the film adheres intimately to and mates with the surface of the container which it covers and retains its shape.

13. The method as claimed in claim 12, wherein the film portion adhering to the upper end portion of the container is separated by cutting along a closed line which closely surrounds said upper end portion.

14. The method as claimed in claim 12, where in the film portion is caused to adhere to the upper end portion of a plurality of containers.

* * * * *